United States Patent [19]

Otake et al.

[11] 3,932,044

[45] Jan. 13, 1976

[54] PEN POINT FOR WRITING INSTRUMENTS

[75] Inventors: Nobuyuki Otake; Yukinori Sato, both of Tokyo; Kozo Ando, Chiba, all of Japan

[73] Assignee: Tokyo Boshi Kabushiki Kaisha, Tokyo, Japan

[22] Filed: Nov. 29, 1974

[21] Appl. No.: 528,277

[30] Foreign Application Priority Data

Dec. 6, 1973 Japan ..... 48-136549

[52] U.S. Cl. ..... 401/265; 401/292

[51] Int. Cl.[2] ..... B43K 1/06

[58] Field of Search ..... 401/198, 199, 265, 292

[56] References Cited

UNITED STATES PATENTS

| | | | |
|---|---|---|---|
| 3,510,227 | 5/1970 | Horie | 401/199 |
| 3,520,629 | 7/1970 | Otsuka | 401/265 X |
| 3,718,401 | 2/1973 | Kiriu | 401/265 |
| 3,778,495 | 12/1973 | Wooley | 401/265 X |
| 3,830,576 | 8/1974 | Koh No et al. | 401/265 X |

*Primary Examiner*—Lawrence Charles

[57] ABSTRACT

Pen point for writing instrument comprising a cylindrical article composed of united thermoplastic synthetic resin monofilaments, said cylindrical article being provided with an even number of more than 4 of radial curved narrow slots having capillary action and extending toward the center of the cylindrical article from the inside of the outer periphery, which are confined by triangular projected segments, top of which segment is circular and side walls of said radial curved narrow slot being formed by a plurality of semicircles, which are arranged so that the semicircles in the opposite side walls are engaged with each other under writing pressure.

6 Claims, 9 Drawing Figures

PEN POINT FOR WRITING INSTRUMENTS

The present invention relates to a thermoplastic synthetic resin pen point to be used for writing instruments, such as a sign pen and the like.

A large number of these pen points have heretofore manufactured particularly for fine handwriting and the internal structures of these pen points have been variously proposed, for example, in Japanese Utility Model Application Publication No. 12,349/67, Japanese Pat. Application Publication No. 27,448/72, U.S. Pat. Nos. 3,338,216, 3,518,019, 3,586,454, 3,614,247 and 3,729,270. These structures are roughly classified as follows.

1. Cross-sectional structure having radial capillary tubes: Japanese Patent Application Publication No. 27,448/72, U.S. Pat. Nos. 3,338,216, 3,518,019, 3,614,247 and 3,729,270.

2. Cross-sectional structure having a lotus root-shaped tubular capillarly tubes: Japanese Utility Model Application Publication No. 12,349/67.

3. Combined capillarly tubes of the above described structures (1) and (2). U.S. Pat. No. 3,586,454.

In general, these pen points aim at fine handwriting as mentioned above and accordingly, the pen points are formed of a thermoplastic synthetic resin into a hard molding so that the bending of the writing tip of the pen point caused by writing pressure is possibly prevented, nevertheless these pen points have a variety of defects owing to the incompleteness of the structure of the center portion of the cross-section, which is most important as the pen point. That is, the pen points having the above described structures have the following defects.

1. Pen point having the above described structure (1):

The triangular projected segments forming the capillary tubes have smooth side walls having no concave and convex projections in the center portion of the cross-section and the top ends are sharp and consequently divergence is caused between mutual projected segments owing to the writing pressure and the writing tip of the pen point is separated. Accordingly, the sharp projections of the projected segments, which are opposed with each other in the center portion, scratch a paper surface upon writing and therefore the feeling is not smooth and the writing tip vibrates, so that ink scatters out to the portion to be written and the paper surface becomes dirty, furthermore this structure is poor in the abrasion resistance.

2. Pen point having the above described structure (2):

Since the tubular capillary tubes are independent, unless a large number of fine tubular capillary tubes are formed, the writing traces are apt to be interrupted and if a large number of fine capillary bores are formed in order to solve this drawback, the flow of ink is poor and ink is apt to clog in the fine capillary bores.

3. Pen point having the above described structure (3):

A core element provided with an independent center fine tubular bore opening extending axially therethrough is provided in the center of the pen point and this core element is not adhered to the core elements of the outside and consequently this core element is difficult to retain its place and is apt to be entered into due to the writing pressure and when such a pen point is used for fine handwriting, the amount of ink discharged from the center bore opening is insufficient, so that the writing trace is apt to be interrupted.

The object of the present invention is to provide the pen point suitable for fine handwriting, in which the above described various defects are solved, the feeling is smooth, the writing trace is not interrupted and the very stable writing performance can be obtained.

The pen point for writing instruments according to the present invention comprises a cylindrical article formed by uniting together a large number of molten thermoplastic synthetic resin monofilaments, said cylindrical article having conical portion in at least one of the ends, which is provided with radial curved narrow slots extending toward the center of the cylindrical article from the inside of the outer periphery of the article in the transverse section, said radial curved narrow slots being confined by an even number of at least 4 of triangular projected segments, each top portion of said triangular projected segments being circular, said triangular projected segments having two different height, the segment having a larger height and the segment having a smaller height being arranged in an adjacent relation, said segments having the larger height being converged in the center portion to form a space bore and side walls of each radial slot being formed by a plurality of semicircles of circumference of the monofilaments and said semicircles in opposite side walls being arranged so as to engage with each other, and further said radial curved narrow slots and the center space bore being axially extended from one end of the cylindrical article to the other end.

For the production of the cylindrical pen points of the above described prior arts having fine spaces acting capillary function in the interior, an extrusion molding is generally most preferable. Namely, a process for extruding a circular rod having various shapes of capillarly tubes, a process comprising extruding non-circular rods or a plate having concave and convex projections and then shaping them in a tube, and the like have been generally adopted.

However, these processes are difficult in the planning and manufacture of dies and further the resulting cylindrical pen points are insufficient in accuracy.

The present invention is als to provide a method for producing the pen points, by which these defects are solved.

In the production of the pen point of the present invention, a thermoplastic synthetic resin is subjected to an extruder provided with a die having a large number of orifices, by which a similar shape as large as several times of the desired cross-sectional shape is obtained, to form monofilaments, the extruded molted monofilaments are united together to form a circular rod having the desired radial narrow slots in the interior, the resulting rod is drawn to the desired diameter and cooled and solidified and the solidified rod is cut into desired length and at least one end of the resulting rod is ground into sharp conical shape.

The present invention will be explained in more detail with reference to Example.

For a better understanding of the invention, reference is taken to the accompanying drawings, wherein.

Figure 1:
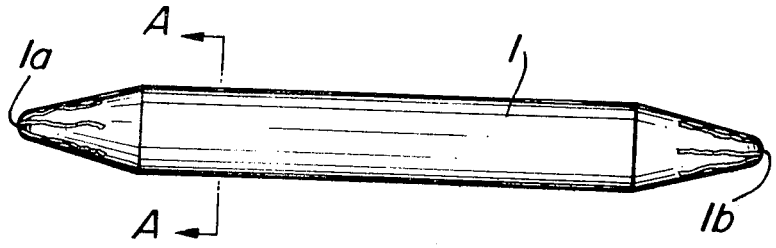
FIG. 1 is a side view of the pen point of the present invention.

FIG. 1 is a side view of the pen point 1 of the present invention. The pen point 1 is formed by extrusion molding of a thermoplastic synthetic resin, such as polyacetal, polyphenylene oxide, nylon, polyolefin and the like into monofilaments and uniting together the molten monofilaments into a rod and then cooling and solidifying the rod and cutting the rod and grounding the both ends of the cut rod into conical shapes 1*a* and 1*b* as mentioned above.

Figure 2:
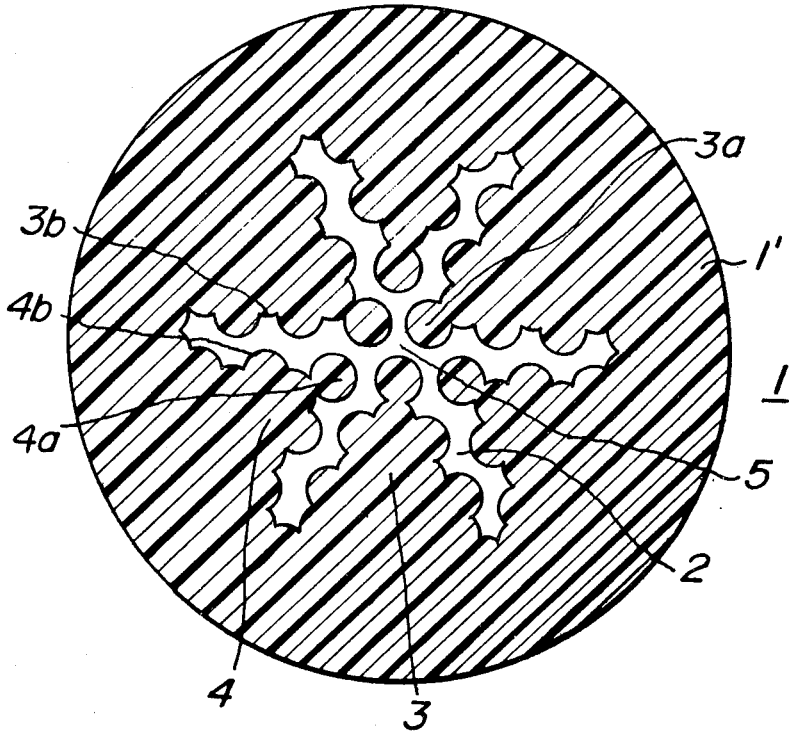
FIG. 2 is an enlarged sectional view taken on lines A—A in FIG. 1.

As shown in FIG. 2, the pen point 1 has six narrow radial curved slots 2 for passing ink, which extend toward the center from the inside of the outer periphery 1′ in the transverse section. The distance between the opposite side walls 3*b* and 4*b* of the narrow slots 2 is within a range of 2/100 to 15/100 mm and about 5/100 mm is most effective. As the result, six triangular projected segments which are connected at the outer periphery portion 1′, are confined by said six radial slots 2. These triangular segments have two different heights, that is a larger height and a smaller height and these segments 3 and 4 are alternately arranged in an adjacent relation and the top portions 3*a* of the three projected segments having the larger height are converged in the center portion so as to form a space bore opening of a central conduit 5 for passing ink. In this case, each of the top portions 4*a* of the projected segments 4 having a smaller height is arranged in a regular triangle and each of top portions 3*a* of the projected segments 3 having a larger height is arranged in the middle point of a side of the regular triangle and the side walls 3*b* and 4*b* of the projected segments 3 and 4 having semicircles formed by the circumference of the monofilaments are arranged so as to engage with each other.

The above described radial curved slots 2 axially extend from one end to the other end in the interior of the pen point 1 and act together with the center bore 5 as the capillary tube for sucking up ink.

Figure 3:
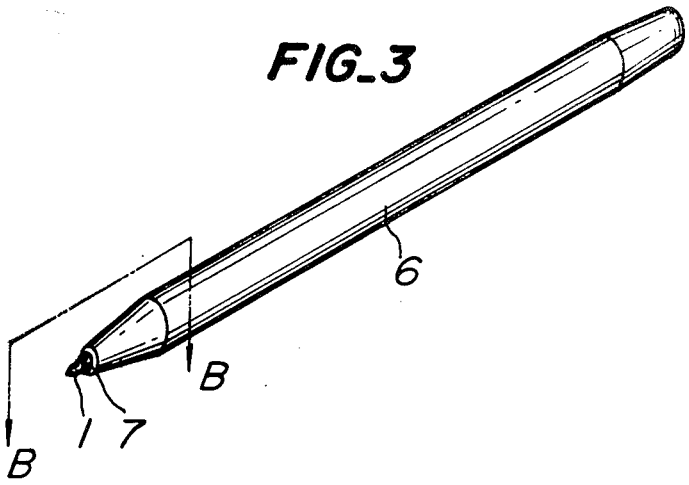
FIG. 3 is a perspective view of the sign pen provided with the pen point of the present invention.
Figure 4:
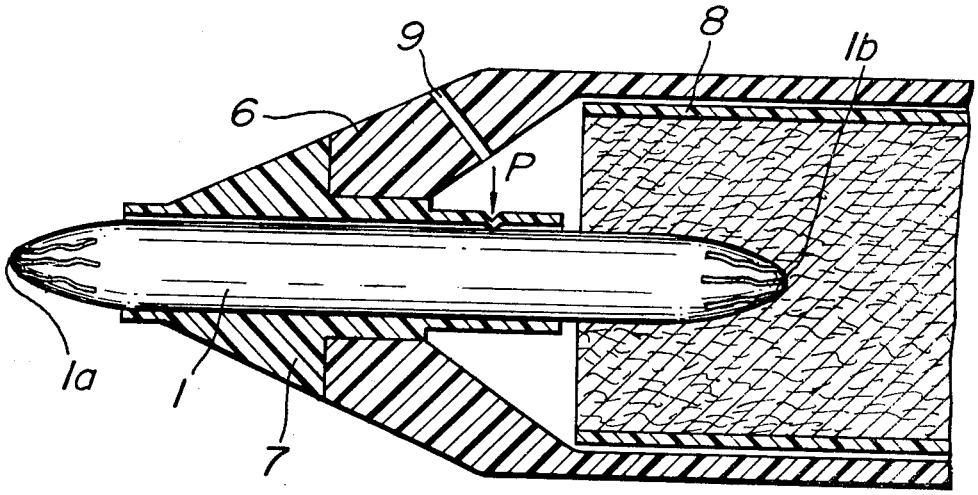
FIG. 4 is an enlarged sectional view taken on lines B—B in FIG. 3.

As shown in FIG. 3, the pen point 1 composed of united monofilaments, if necessary, is inserted into a nib holder 7 and is pressed fit thereby and then is provided in the pen body 6 of writing instruments, such as sign pen and the like. In this case, the pen point 1 is fit to the nib holder 7 by pressing the nib holder in the arrow P direction (see FIG. 4). When the pen point is fixed in the pen body 6 through the nib holder 7 or directly by an appropriate means, a terminal end 1*b* of the pen point 1 is inserted into a reservoir 8 arranged in the pen body 6 and filled with ink. This has been already known.

Reference number 9 shows an air passageway formed in the pen body 6.

The above mentioned thermoplastic synthetic resins to be used for the pen point are selected depending upon the desired writing performance. For example, when polyacetal is used, the pen point having a hard and smooth feeling can be obtained and when polyethylene is used, the pen point having a soft and smooth feeling can be obtained.

The pen point 1 having the above described construction is slightly bent at the writing tip 1a under the writing pressure but the side wall portions 3*b* and 4*b* of the projected segments 3 and 4 having the different height, which are arranged adjacently with each other, are engaged, so that the relative displacement between the projected segments 3 and 4 is prevented and the toughness is improved. Accordingly, the separation as in the conventional pen points is not caused in the writing tip 1*a*. Furthermore, the top portions 3*a* and 4*a* of the projected segments 3 and 4 are substantially circular, so that the writing tip 1a does not scratch the paper surface upon writing and moves smoothly and hence the pen tip does not vibrate. Accordingly, the smooth write feeling can be obtained and ink does not scatter.

Moreover, when the writing tip 1a is slightly bent by the writing pressure, the narrow slot 2 of the pen point 1 comes in contact with the paper surface, so that the ink can be surely supplied to the paper surface.

As mentioned above, the narrow slots 2 have the radial curves, so that the surface area is larger and therefore the ink sucking up action as the capillary tube is larger and further the flooding of ink on the paper surface can be prevented. Moreover, the center bore 5 acting as a very fine capillary tube having a large sucking up action is formed at the center portion of the writing tip portion 1*a* by the circular top portions 3*a* of the projected segments 3 oppositely arranged at the center, so that ink is fully supplied to the writing tip 1*a* and the writing trace is not interrupted. Therefore, this pen point is very suitable for writing fine line letters rapidly.

The pen point in the above described Example is formed by six radial curved narrow slots 2 but the present invention is not limited thereto. However, the projected segments 3 and 4 having a larger height and a smaller height must be arranged alternately, so that the number of the slots must be an even number of more than 4.

As the other embodiments, there may be the pen points having the following sectional structures.

Figure 7:
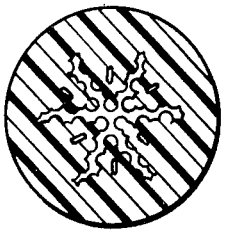
FIGS. 7–9 show the cross-sectional views of the other embodiments of pen points of the present invention.

In one embodiment, a small bore for conveying ink is provided at the center portion of each triangular projected segment (see FIG. 7). When small bores are provided as shown in FIG. 7, even if the writing is effected by inclining the pen point, ink is flowed smoothly and the writing trace is scarcely interrupted.

Alternatively, the pen point having the crosssection as shown in FIG. 2 may be covered by an outer coating. When the diameter of core portion is 1.2 mm$\phi$ and the outer diameter of the coating including the core is 2.0 mm$\phi$, the coating protects and reinforces the core, so that the strength of the entire pen point is improved and the writing tip is hardly bent by the writing pressure upon writing and the write feeling is hard.

Furthermore, in such a pen point, it is prevented by the coating that the capillary tubes are collapsed by holding pressure of the nib holder when assembling the writing instrument. Such a pen point is hard and can be used for fine handwriting and further the toughness is higher.

Figure 8:
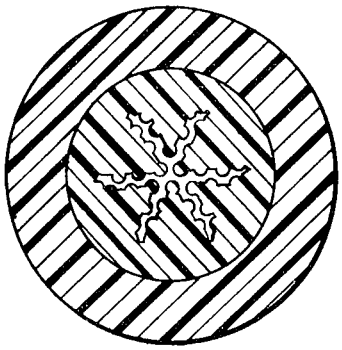

The embodiment when the coating is circular is shown in FIG. 8.

Figure 9:
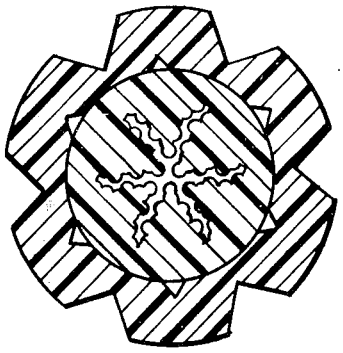

The coating may be provided with air passageways as shown in FIG. 9.

The coating material to be used herein may be different from or same as the material to form the core portion.

The coating may be colored.

Figure 5:
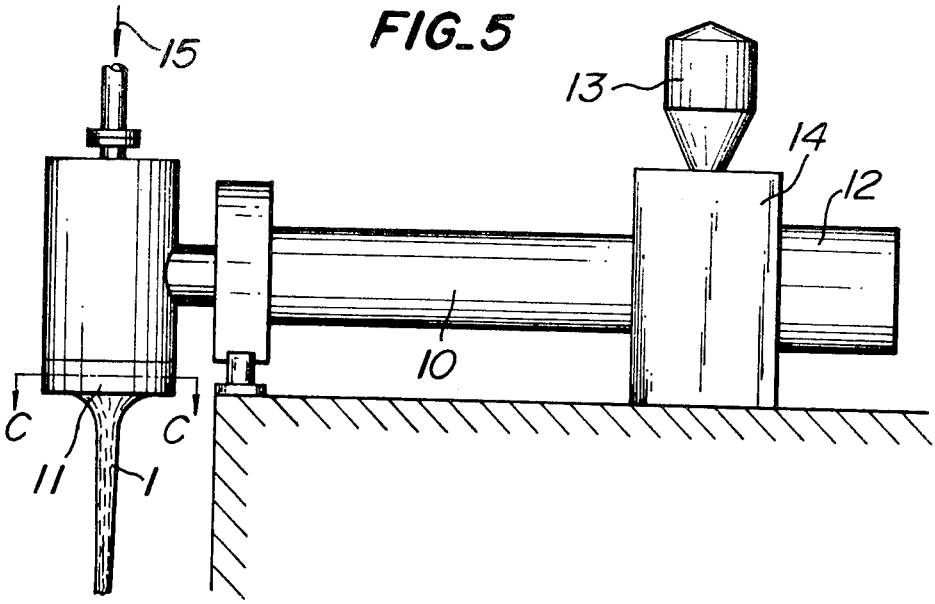
FIG. 5 is a side view showing an outline of an apparatus for producing the pen point of the present invention.
Figure 6:
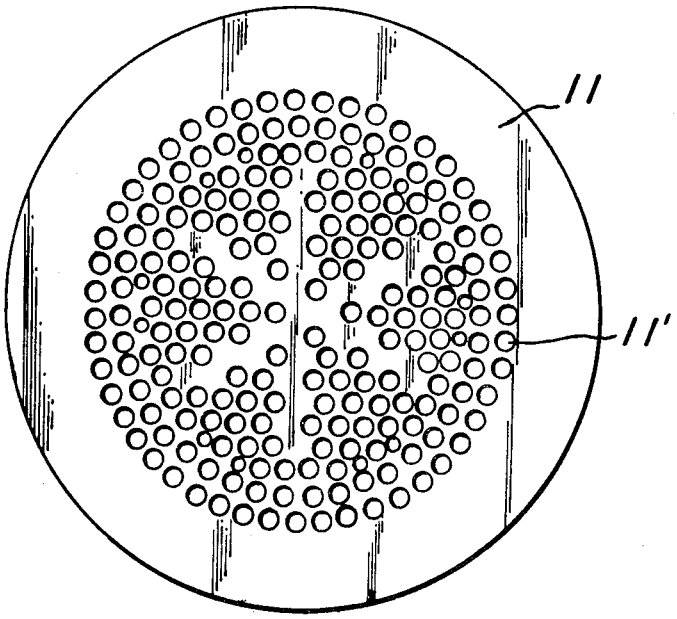
FIG. 6 is an enlarged sectional view of the die taken on lines C—C in FIG. 5.

The pen point according to the present invention, for example, is produced by the following manner and an explanation will be made with reference to FIG. 5.

An extruder 14 is provided with a die 11, which has a large number of independent extruding orifices 11' to form a similar shape as large as several times of the crosssectional shape as shown in FIG. 2.

Thermoplastic synthetic resin pellets to produce the pen point are supplied from a hopper 13 to a heating zone 10 and are heated therein and simultaneously a main screw (not shown) is rotated by a motor 12 and the molten resin is supplied to a die 11 under a given pressure. At the same time, air is fed from an air supplying tube 15. The molten resin is extruded through the extruding orifices 11' of the die 11 into a large number of monofilaments and then the molten monofilaments are united together to form a circular rod having the desired radial curved slots therein. The resulting circular rod is drawn to the desired diameter by a device not shown and cooled and solidified and cut into the desired length. Both the ends of the cut rod are ground to form a pen point 1 as shown in FIG. 1.

In the above described process, the radial curved slots having a capillary action can be formed in the resin rod by providing the extruding orifices 11' for forming monofilament in the die 11 and these extruding orifices 11' can be arranged in the desired distance. Accordingly, the planning and manufacture of the die are very easy and the accuracy is high, so that the accuracy of the shaped article can be noticeably improved as compared with the conventional products.

What is claimed is:

1. Pen point for writing instruments comprising a cylindrical article formed by uniting together a large number of molten thermoplastic synthetic resin monofilaments, said cylindrical article having a conical portion at least at one end, which is provided with radial curved narrow slots extending toward the center of the cylindrical article from the inside of the outer periphery of the article in the transverse section, said radial curved narrow slots being defined by an even number of at least 4 of triangular projected segments, each top portion of said triangular projected segments being circular, said triangular projected segments having two different heights, the segment having a larger height and the segment having a smaller height being arranged in an adjacent relation, said segments having the larger height being converged in the center portion to form a space bore and side walls of each radial slot being formed by a plurality of semicircles and said semicircles in opposite side walls being arranged so as to engage with each other under writing pressure, and further said radial curved narrow slots and the center space bore being axially extended from one end of the cylindrical article to the other end.

2. The pen point as claimed in claim 1, wherein six radial curved narrow slots are provided.

3. The pen point as claimed in claim 1, wherein said pen point is composed of polyacetal, polyphenylene oxide, nylon or polyolefin.

4. The pen point as claimed in claim 1, wherein each of said triangular projected segments is provided with a center bore for conveying ink.

5. The pen point as claimed in claim 1, wherein said cylindrical article is covered with a thermoplastic synthetic resin circular coating.

6. The pen point as claimed in claim 1, wherein said cylindrical article is covered with a thermoplastic synthetic resin coating provided with a plurality of air passageways.

* * * * *

UNITED STATES PATENT AND TRADEMARK OFFICE

Certificate

Patent No. 3,932,044 Patented January 13, 1976

Nobuyuki Otake, Yukinori Sato and Kozo Ando

Application having been made by Nobuyuki Otake, Yukinori Sato and Kozo Ando, the inventors named in the patent above identified, and Tokyo Boshi Kabushiki Kaisha the assignee, for the issuance of a certificate under the provisions of Title 35, Section 256, of the United States Code, adding the name of Hironobu Hori as a joint inventor, and a showing and proof of facts satisfying the requirements of the said section having been submitted, it is this 26th day of Mar., 1985, certified that the name of the said Hironobu Hori is hereby added to the said patent as a joint inventor with the said Nobuyuki Otake, Yukinori Sato and Kozo Ando.

Fred W. Sherling,
*Associate Solicitor.*

REEXAMINATION CERTIFICATE (249th)

United States Patent [19]

Otake et al.

[11] B1 3,932,044

[45] Certificate Issued Sep. 18, 1984

[54] PEN POINT FOR WRITING INSTRUMENTS

[75] Inventors: Nobuyuki Otake; Yukinori Sato, both of Tokyo; Kozo Ando, Chiba, all of Japan

[73] Assignee: Tokyo Boshi Kabushiki Kaisha, Tokyo, Japan

Reexamination Request:
No. 90/000,385, Jun. 1, 1983

Reexamination Certificate for:

| | |
|---|---|
| Patent No.: | **3,932,044** |
| Issued: | **Jan. 13, 1976** |
| Appl. No.: | **528,277** |
| Filed: | **Nov. 29, 1974** |

[30] Foreign Application Priority Data

Dec. 6, 1973 [JP] Japan ..... 48-136549

[51] Int. Cl.[3] ..... B43K 1/06; A46B 11/04

[52] U.S. Cl. ..... 401/265; 401/292

[58] Field of Search ..... 401/198, 199, 265, 292

[56] References Cited

U.S. PATENT DOCUMENTS

| | | |
|---|---|---|
| 3,203,025 | 8/1965 | Scheur . |
| 3,338,216 | 8/1967 | Roller . |
| 3,361,516 | 1/1968 | Rigondaud . |
| 3,400,998 | 9/1968 | Daugherty . |
| 3,424,539 | 1/1969 | Jenkins . |
| 3,442,739 | 6/1969 | Johnson . |
| 3,464,775 | 9/1969 | Beal . |
| 3,467,478 | 9/1969 | Webber . |
| 3,467,564 | 9/1969 | Daugherty . |
| 3,474,703 | 10/1969 | Davis . |
| 3,480,372 | 11/1969 | Kenny . |
| 3,510,227 | 5/1970 | Horie . |
| 3,518,019 | 6/1970 | Nakamura . |
| 3,520,629 | 7/1970 | Otsuka . |
| 3,538,208 | 11/1970 | Ohtsuka . |
| 3,558,392 | 1/1971 | Goodenow . |
| 3,572,954 | 3/1971 | Cheron . |
| 3,586,454 | 6/1971 | Funahashi . |
| 3,604,817 | 9/1971 | Funahashi . |
| 3,614,247 | 10/1971 | Otsuka . |
| 3,614,248 | 10/1971 | Otsuka . |
| 3,617,325 | 11/1971 | Spokes . |
| 3,623,941 | 11/1971 | Goodenow . |
| 3,627,868 | 12/1971 | Funahashi . |
| 3,666,535 | 5/1972 | Woolley . |
| 3,715,254 | 2/1973 | Tolgyesi . |
| 3,718,401 | 2/1973 | Kiriu . |
| 3,729,270 | 4/1973 | Nakano . |
| 3,778,495 | 1/1973 | Woolley . |
| 3,830,576 | 8/1974 | Kohno . |
| 3,843,270 | 10/1974 | Kiriu . |

FOREIGN PATENT DOCUMENTS

| | | |
|---|---|---|
| 443520 | 5/1970 | Australia . |
| 591686 | 2/1960 | Canada . |
| 839461 | 4/1970 | Canada . |
| 1910268 | 9/1969 | Fed. Rep. of Germany . |
| 1900832 | 3/1970 | Fed. Rep. of Germany . |
| 1561819 | 4/1970 | Fed. Rep. of Germany . |
| 1903452 | 8/1970 | Fed. Rep. of Germany . |
| 1961975 | 6/1970 | Fed. Rep. of Germany . |
| 1959871 | 2/1971 | Fed. Rep. of Germany . |
| 296081 | 1/1972 | Fed. Rep. of Germany . |
| 2110203 | 7/1972 | Fed. Rep. of Germany . |
| 2104054 | 8/1972 | Fed. Rep. of Germany . |
| 1729064 | 5/1973 | Fed. Rep. of Germany . |
| 2225330 | 12/1973 | Fed. Rep. of Germany . |
| 1261352 | 4/1961 | France . |
| 1325535 | 3/1963 | France . |
| 1485772 | 6/1967 | France . |
| 1527955 | 6/1968 | France . |
| 1588546 | 4/1970 | France . |
| 2101553 | 3/1972 | France . |
| 42-12349 | 7/1967 | Japan . |
| 42-63217 | 4/1968 | Japan . |
| 43-30014 | 12/1968 | Japan . |
| 44-7843 | 3/1969 | Japan . |
| 45-1130 | 1/1970 | Japan . |
| 45-16886 | 7/1970 | Japan . |
| 47-27448 | 7/1972 | Japan . |
| 48-11881 | 3/1973 | Japan . |
| 48-73037 | 9/1973 | Japan . |
| 48-73038 | 9/1973 | Japan . |
| 48-36841 | 11/1973 | Japan . |
| 48-36842 | 11/1973 | Japan . |
| 48-36843 | 11/1973 | Japan . |
| 480196 | 12/1969 | Switzerland . |
| 816877 | 7/1959 | United Kingdom . |
| 843179 | 8/1960 | United Kingdom . |
| 947183 | 1/1964 | United Kingdom . |
| 1163669 | 9/1969 | United Kingdom . |
| 1170018 | 11/1969 | United Kingdom . |
| 1198016 | 7/1970 | United Kingdom . |
| 1202347 | 8/1970 | United Kingdom . |
| 1231956 | 5/1971 | United Kingdom . |
| 1317312 | 5/1973 | United Kingdom . |
| 294305 | 3/1971 | U.S.S.R. . |

OTHER PUBLICATIONS

Publication #2-Unique Nibs-Tokyo Hat, 9/21/71.
Publication #7-Unique Nibs-Tokyo Hat, 10/15/72.
Publication #8-Unique Nibs-Tokyo Hat, 10/15/72.
Publication #9-Unique Nibs-Tokyo Hat, 11/15/72.
Pilot Times, vol. 43, No. 2-Pilot, 3/1970.

*Primary Examiner*—Stephen C. Pellegrino

[57] ABSTRACT

Pen point for writing instrument comprising a cylindrical article composed of united thermoplastic synthetic resin monofilaments, said cylindrical article being provided with an even number of more than 4 of radial curved narrow slots having capillary action and extending toward the center of the cylindrical article from the inside of the outer periphery, which are confined by triangular projected segments, top of which segment is circular and side walls of said radial curved narrow slot being formed by a plurality of semicircles, which are arranged so that the semicircles in the opposite side walls are engaged with each other under writing pressure.

REEXAMINATION CERTIFICATE ISSUED UNDER 35 U.S.C. 307.

NO AMENDMENTS HAVE BEEN MADE TO THE PATENT.

AS A RESULT OF REEXAMINATION, IT HAS BEEN DETERMINED THAT:

The patentability of claims 1–6 is confirmed.

* * * * *